US006263954B1

(12) United States Patent
Nakayama

(10) Patent No.: US 6,263,954 B1
(45) Date of Patent: Jul. 24, 2001

(54) MOUNT BRACKET FOR AN ELONGATE MANIFOLD OF A HEAT EXCHANGER AND METHOD OF ASSEMBLING THE SAME

(75) Inventor: Ken Nakayama, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/513,565

(22) Filed: Feb. 25, 2000

(51) Int. Cl.[7] ..... F28F 9/00
(52) U.S. Cl. ..... 165/67; 248/74.1; 29/890.03
(58) Field of Search ..... 165/67, 149; 248/74.1, 248/74.3, 65, 315; 29/890.03; 228/183

(56) References Cited

U.S. PATENT DOCUMENTS

| | | | | |
|---|---|---|---|---|
| 1,246,325 | * | 11/1917 | Rohmer | 248/74.3 |
| 5,069,275 | * | 12/1991 | Suzuki et al. | 165/67 |
| 5,183,103 | * | 2/1993 | Tokutake | 165/67 |
| 5,407,161 | * | 4/1995 | Mulkeran | 248/232 |
| 5,429,182 | * | 7/1995 | Hanafusa | 165/67 |

FOREIGN PATENT DOCUMENTS

| | | | | |
|---|---|---|---|---|
| 3-164694 | * | 7/1991 | (JP) | 165/67 |

* cited by examiner

*Primary Examiner*—Allen Flanigan
(74) *Attorney, Agent, or Firm*—Wood, Phillips, VanSanten, Clark & Mortimer

(57) ABSTRACT

A mount bracket (30) is provided for an elongate manifold (12) of a heat exchanger (10). The manifold (12) has a longitudinal axis (32) and a mount bracket receiving exterior surface (34) extending over at least a portion of the longitudinal length of the manifold (10). The mount bracket (3) includes a body (40) formed from a single piece of material. The body (40) includes a mount tab (42), first and second opposed bands (44,46) each of which have a first end segment (56,60) spaced from a second-end segment (58,62), a first bridge segment (68) connecting the first end segments (56,60) of the first and second bands (44,46), and a second bridge segment (70) connecting the second end segments (58,62) of the first and second bands (44,46). The mount tab (42) is configured to connect the mount bracket (30) to a structure other than the manifold (12). The first and second opposed bands define a manifold receiving opening (50) shaped to nominally conform to the mount bracket receiving exterior surface (34). The first band (44) is spaced longitudinally from the second band (46) with the bracket (30) mounted on the manifold (12). The first band (44) defines a first portion (54) of the opening (50), and the second band (46) defines a second portion (55) of the opening (50) opposite the first portion (54). The body (40) is permanently deformable from a first state wherein the bands (44,46) will slidably receive the surface (34) in the opening (50) with a slip-fit, and a second state wherein the bands (44,46) will clamp the surface (34) in the opening (50).

30 Claims, 4 Drawing Sheets

MOUNT BRACKET FOR AN ELONGATE MANIFOLD OF A HEAT EXCHANGER AND METHOD OF ASSEMBLING THE SAME

FIELD OF THE INVENTION

This invention relates to heat exchangers, and more particularly, to heat exchangers having an elongate manifold, such as a header, with a mount bracket attached to the manifold.

BACKGROUND OF THE INVENTION

There are many known forms of heat exchangers that include a manifold that collects and/or distributes working fluid to and/or from other conduits of the heat exchanger. It is known to attach a mount bracket to such manifolds for mounting the heat exchanger to a support structure or for mounting another component to the heat exchanger. Commonly, the mount brackets are brazed to the manifold, with the brackets being held relative to the manifold during the brazing operation. This is typically done either with fixtures or by tack welding the bracket to the header. Clamp type mount brackets are also used on manifolds, with threaded fasteners that clamp the components of the bracket to the manifold. While these types of bracket to manifold assemblies may be acceptable for their intended purpose, their use is frequently labor intensive in terms of affixing the bracket to the header, alignment of the clamp type brackets with the header, machining of the clamp type brackets, and/or misalignment of the brackets before the brazing process can be completed.

SUMMARY OF THE INVENTION

It is a principal object of the invention to provide a new and improved mount bracket for an elongate manifold of a heat exchanger and a method for assembling the same.

According to one facet of the invention, a mount bracket is provided for an elongate manifold of a heat exchanger. The manifold has a longitudinal axis and a mount bracket receiving exterior surface extending over at least a portion of the longitudinal length of the manifold.

According to one facet of the invention, the mount bracket includes a body formed from a single piece of material. The body includes a mount tab, first and second opposed bands each of which have a first end segment spaced from a second-end segment, a first bridge segment connecting the first end segments of the first and second bands, and a second bridge segment connecting the second end segments of the first and second bands. The mount tab is configured to connect the mount bracket to a structure other than the manifold. The first and second opposed bands define a manifold receiving opening shaped to nominally conform to the mount bracket receiving exterior surface of the manifold. The first band is spaced longitudinally from the second band with the bracket mounted on the manifold. The first band defines a first portion of the opening, and the second band defines a second portion of the opening opposite the first portion. The body is permanently deformable from a first state wherein the bands will slidably receive the mount bracket receiving exterior surface in the manifold receiving opening with a slip-fit, and a second state wherein the bands will clamp the mount bracket receiving exterior surface in the manifold receiving opening.

According to another facet of the invention, the mount bracket includes a body formed from a single piece of material and a mount tab as before. First, second, and third bands define longitudinally spaced, coaxial manifold receiving openings shaped to nominally conform to the mount bracket receiving exterior surface of the manifold, with each of the first, second, and third bands having a first end segment spaced from a second end segment. A first bridge segment connects the first end segments of the first and second bands; a second bridge segment connects the second end segments of the first and second bands; a third bridge segment connects the first end segments of the third and second bands; and a fourth bridge segment connects the second end segments of the third and second bands. The first and seconds bands are spaced longitudinally from the second band on opposite sides of the second band with the bracket mounted on the manifold. The first and second bands define a first one of the openings, and the second and third bands define a second one of the openings spaced longitudinally from the first one of the openings. The body is permanently deformable from a first state wherein the bands will slidably receive the mount bracket receiving exterior surface in the manifold receiving opening with a slip fit, and a second state wherein the bands will clamp the mount bracket receiving exterior surface in the manifold receiving openings.

In accordance with still another facet of the invention, a manifold/mount bracket assembly for a heat exchanger is provided as before and additionally includes an outwardly extending projection formed on the mount bracket receiving exterior surface. Further included is at least one aperture in at least one of the bands. The aperture(s) receives the projections formed on the mount bracket receiving exterior surface.

In accordance with still a further facet of the invention, a method is provided for assembling a mount bracket to an elongate manifold of a heat exchanger. The method includes the steps of:

(a) inserting a manifold into an opening defined by first and second opposed bands of a mount bracket;

(b) permanently deforming the mount bracket to reduce a dimension of the opening to bring the first and second bands into clamping contact with the manifold; and (c) permanently deforming the manifold to create a projection that is engaged in an aperture in one of the first and second opposed bands.

In accordance with still another facet of the invention, a method is provided for assembling a mount bracket to an elongate manifold of a heat exchanger. The method includes the steps of:

(a) inserting a manifold into an opening defined by first and second opposed bands of a mount bracket;

(b) permanently deforming the mount bracket to reduce a dimension of the opening to bring the first and second bands into contact with the manifold; and (c) bonding at least one of the bands to the manifold after step (b).

Other objects, features, and advantages of the invention will be apparent from the following detailed description taken in conjunction with the accompanying drawings, the above summary, and the appended claims.

DETAILED DESCRIPTION OF THE PREFERRED EMBODIMENTS

Figure 1:
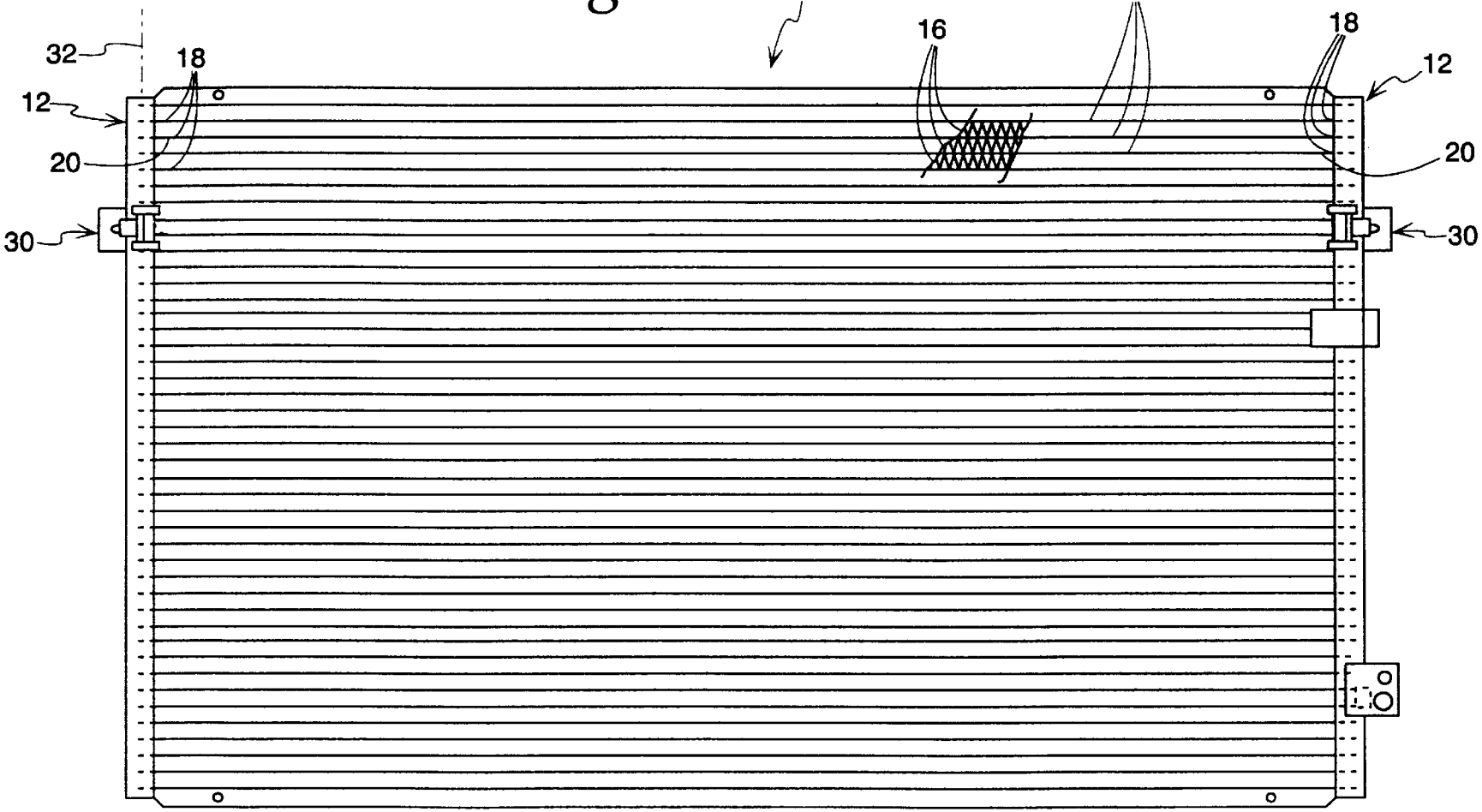
FIG. 1 is a front elevation of a heat exchanger including an elongate manifold and a mount bracket embodying the present invention.

Several exemplary embodiments of a mount bracket for an elongate manifold are illustrated in the drawings in connection with a parallel flow heat exchanger 10 including a pair of elongate manifolds in the form of cylindrical, tubular headers 12, a plurality of multi-port, flattened tubes 14 extending between the headers 12, and serpentine fins 16 (shown schematically in FIG. 1) extending between adjacent one of the tubes 14. However, it should be understood that the invention may find utility in other forms of heat exchangers utilizing other types of manifolds, fins, and heat exchanger tubes or conduits, such as, for example, cylindrical heat exchange tubes, plate fins, or serpentine-type heat exchangers. Moreover, the manifolds need not be cylindrical in cross section. By way of example, but without limitation, oval shaped or rectangular cross sections may be employed. Accordingly, no limitation to use with a specific form of heat exchanger is intended except in so far as expressly stated in the appended claims.

With reference to FIG. 1, each of the headers 12 on its side facing the other includes a plurality of tube slots 18 which are aligned with tube slots 18 in the opposite header. The plurality of tubes 16 have their ends 20 received in sealed relation in corresponding ones of the slots 18. A mount bracket 30 is attached to at least one of the headers 12.

Figure 2:
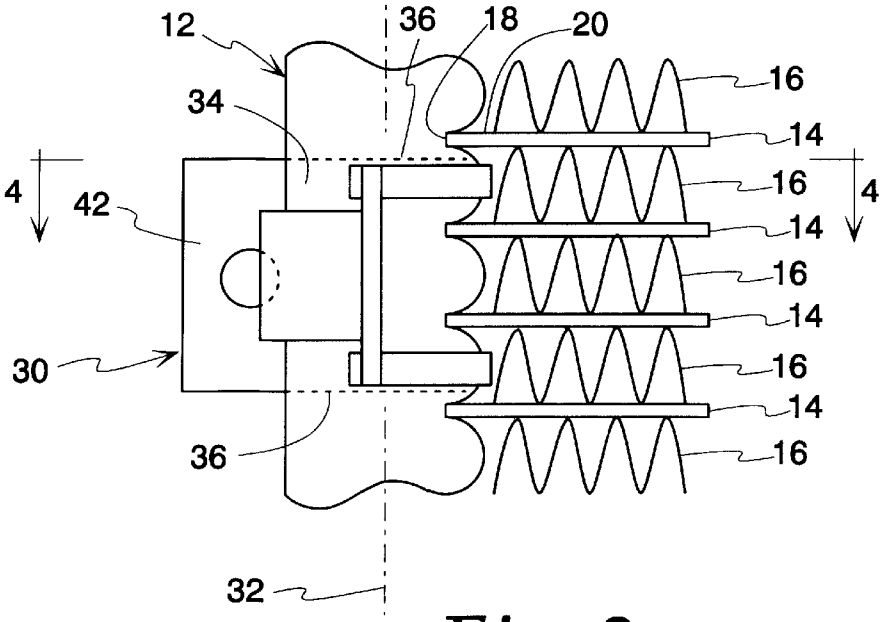
FIG. 2 is an enlarged, partial view of the elongate manifold and mount bracket.

With reference to FIG. 2, the header 12 has a longitudinal axis 32, and a mount bracket receiving exterior surface 34 extending over at least a portion of the longitudinal length of the header 12, as indicated by phantom lines 36. In the illustrated embodiment, the header 12 is nominally cylindrical and the mount bracket receiving exterior surface 34 has a transverse cross section that is nominally circular, with occasional discontinuities resulting from the formation of the tube slots 18.

Figure 3:
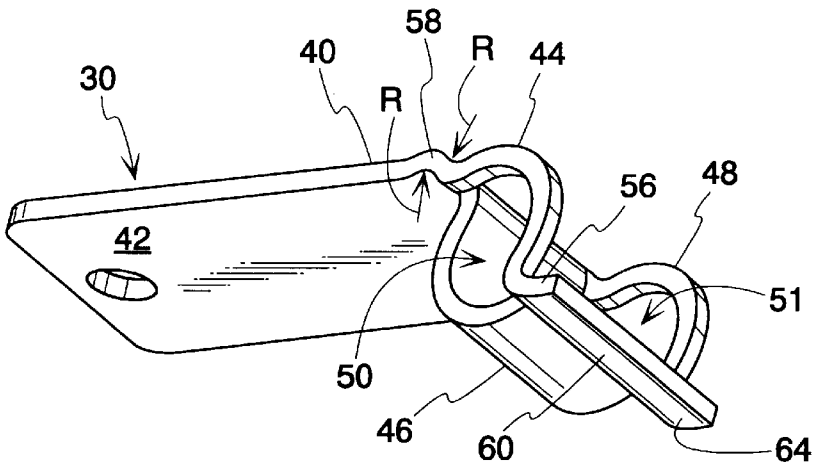
FIG. 3 is a perspective view of the mount bracket shown in FIG. 1.
Figure 4:
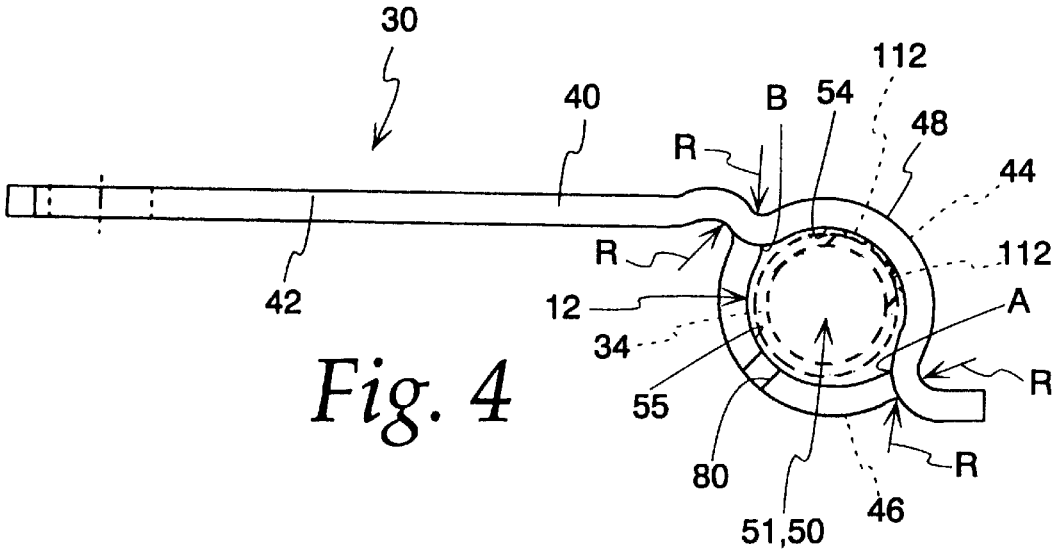
FIG. 4 is a sectional view taken along line 4—4 in FIG. 1 showing the mount bracket in a first state.
Figure 5:
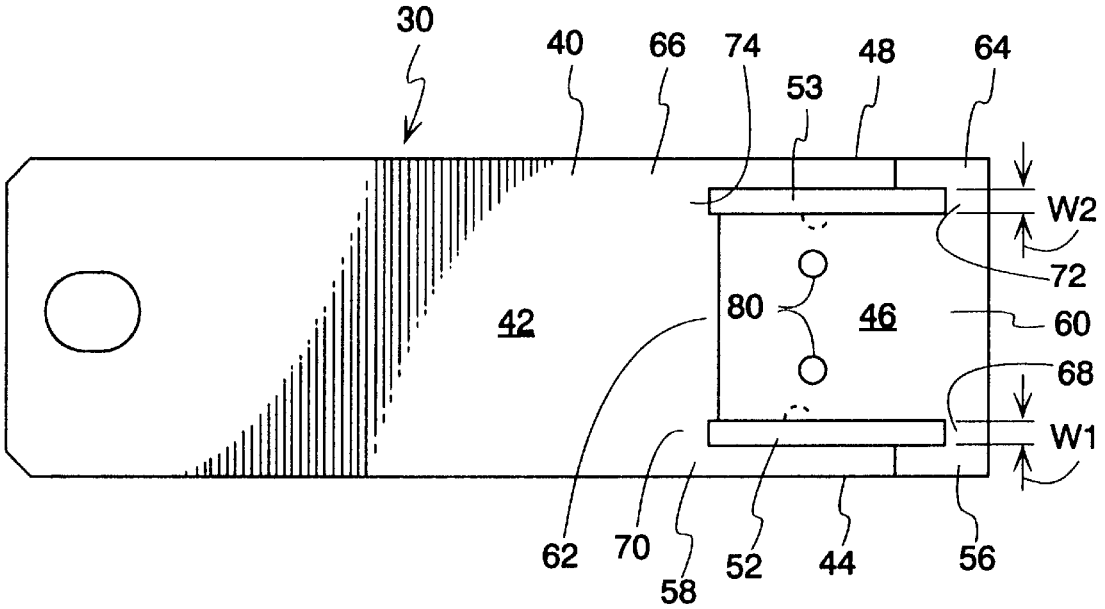
FIG. 5 is a plan view of the mount bracket.
Figure 6:
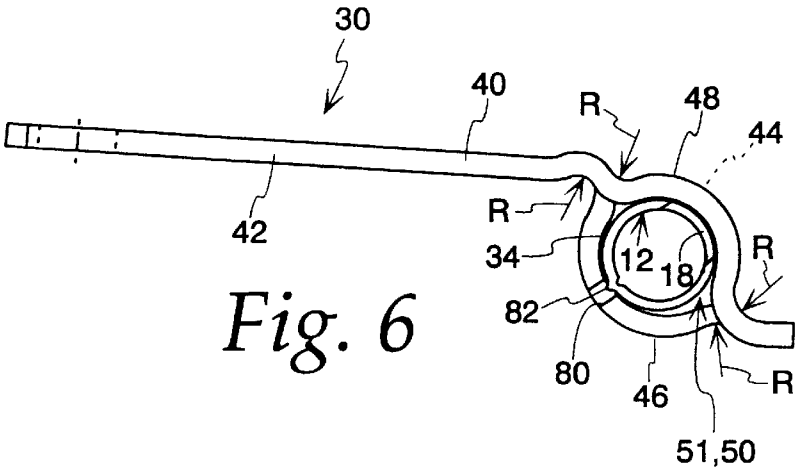
FIG. 6 is a sectional view similar to FIG. 4 showing the mount bracket in a second state.

As best seen in FIG. 3, the bracket 30 has a body 40 formed from a single piece of material, which in one embodiment is aluminum AA 3003-H14. The body 40 includes a mount tab 42 that is configured to connect the mount bracket to a structure other than the header 12. The body 40 further includes first, second and third bands 44, 46 and 48, respectively, that define a pair of header receiving openings 50 and 51 shaped to nominally conform to the mount bracket receiving exterior surface 34. In the illustrated embodiment, the openings 50 and 51 have a nominally circular shape. As best seen in FIG. 5, the first and third bands 44 and 48 are spaced longitudinally from the second band 46 by a pair of slots 52 and 53 on opposite sides of the second band 46. The slot 52 has a width W1, and the slot 53 has a width W2. As best seen in FIG. 4, the first and third bands 44 and 48 define first portions 54 of the header receiving openings 50 and 51, respectively, extending counterclockwise from point A to point B. The second band 46 defines second portions 55 of the openings 50 and 51, extending clockwise from point A to point B opposite the first portions 54. The first band 44 has a pair of end segments 56 and 58 spaced from each other along the length of the band 44. The second band 46 has a pair of end segments 60 and 62 spaced from each other along the length of the band 46. The third band 48 has a pair of end segments 64 and 66 spaced from each other along the length of the band 48. A first bridge segment 68 spans the width W1 of the slot 52 to connect the first end segments 56 and 60 of the first and second bands 44 and 46. A second bridge element 70 spans the width W1 of the slot 52 to connect the second end segments 58 and 62 of the first and second bands 44 and 46. A third bridge element 72 spans the width W2 of the slot 53 to connect the first and second end segments 60 and 64 of the second and third bands 46 and 48. A fourth bridge segment 74 spans the width W2 of the slot 53 to connect the second end segments 62 and 66 of the second and third bands 46 and 48. As best seen in FIG. 4 each of the end segments 56, 58, 60, 62, 64, and 66 have a blend or bend radius R that transitions the respective bands 44, 46 and 48 into their respective bridge segments 68, 70, 72 and 74. As best seen in FIG. 5, the body 40 of the bracket 30 further includes a pair of apertures 80 shown in the form of cylindrical, through bores in the band 46. As best seen in FIG. 6, these apertures 80 receive projections 82 (only one shown in FIG. 6) illustrated in the form of dimples that are formed during the assembly process on the surface 34 of the header 12 and extend outwardly therefrom.

As best seen in FIG. 2, in the illustrated embodiment, each of the bands 44 and 48 is located so that it engages the surface 34 of the header 12 between adjacent pairs of the tubes 14 and tube slots 18 with the bracket 30 mounted on the header 12. Preferably, the band 46 and apertures 80 are located opposite at least one of the tube slots 18 with the band 46 engaging the surface 34.

Advantageously, the bracket 30 may be formed from a flat piece of sheet stock by first forming the slots 52 and 53 and then expanding the bands 44, 46, and 48 to form the openings 50 and 51 to their desired shape. The formation of the slots 52 and 52, and the expansion of the bands 44, 46, and 48 may be performed using any suitable material forming technique. Similarly, the bend radii R of the end segments 56, 58, 60, 62, 64, and 66, and the configuration of the mount tab 42 may also be formed using suitable material forming techniques.

As best seen in FIG. 4, the bracket 30 has a first state wherein the bands 44, 46 and 48 will slidably receive the mount bracket receiving exterior surface 34 (shown with phantom lines in FIG. 4) in the header receiving openings 50 and 51 with a slip fit to allow the bracket 30 to be installed over the header 12. As best seen in FIG. 6, the bracket has a second state wherein the body 40 is permanently deformed from the first state so that the bands 44, 46 and 48 will contact and/or clamp the mount bracket receiving exterior surface 34 in the header receiving openings 50 and 51. More specifically, the body 40 is permanently deformed to reduce at least one dimension of the openings 50 and 51 to bring the bands 44, 46, and 48 into contact with the header 12. In the illustrated embodiment, the permanent deformation results in a reduction in the peripheries of the openings 50 and 51 from the first state, and a reduction in the transverse diameters of the openings 50 and 52 over at least selected portions of the openings 50 and 51.

Figure 7:
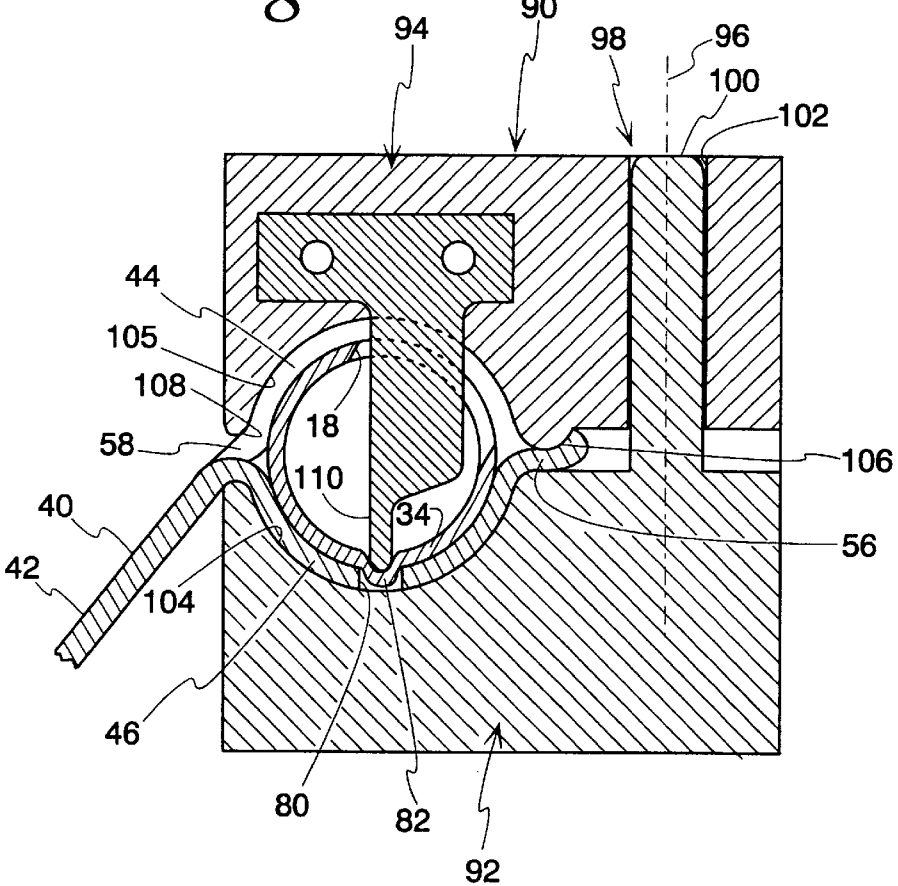
FIG. 7 is a sectional view similar to FIGS. 4 and 6 showing the mount bracket, the manifold, and a die tool set used to attached the mount bracket to the manifold.

As best seen in FIG. 7, in the preferred embodiment a set of die tools 90 are used to accomplish the transition between the first and second state. The die set 90 includes a stationary die tool 92 and a movable die tool 94 that translates relative to the die tool 92 along an axis 96 defined by a guide 98 between the die tools 92 and 94. The guide 98 includes a guidepost 100 extending from the die tool 92 into a bore 102 formed in the die tool 94. The die tool 92 includes a support surface 104 that nominally conforms to the band 46. The die tool 94 includes two spaced surfaces (only one shown in FIG. 7) that are aligned to contact the bands 44 and 48, respectively, and used to define the permanently deformed shape of the bands 44 and 48. In this regard, each of the surfaces 104 includes a pair of contact areas 106 and 108 aligned to contact the corresponding end segments 56, 64 and 58, 66 of the bands 44 and 48 at the bend radii R and then permanently deform the bands 44 and 48 relative to the band 46 via the contact with the end segments 56, 58, 64, and 66 as the die tools 92 and 94 are moved toward each other to place the bracket 30 in the second state. This permanent deformation will typically include movement of the bands 44 and 48 toward the band 46 and a reduction in the size of the bend radii R of the end segments 56, 58, 64, and 66. Additionally, in the illustrated embodiment, the die 94 carries a pair of punch tools 110 (only one shown in FIG. 7), each of which is configured to extend through a tube slot 18 to engage the interior of the header 12 oppositely of the tube slot and form one of the projections 82 onto the surface 34 so that it extends into its corresponding aperture 80 as the die tools 92 and 94 move towards each other. Thus, in the illustrated embodiment, the permanent deformation of the bracket into the second state and the permanent deformation of the header 12 to form the projection 82 occur at nominally the same time. However, it should be noted, that in some applications it may be more desirable for the projections 82 to be formed by another die set either before or after the permanent deformation of the bracket 30 into the second state. For example, in some applications, the orientation of the mount tab 42 with respect to each of the tube slot 18 through which each of the punches 110 must extend may not allow for each of the punches 110 to extend through their respective tube slot 18 as the die tool 94 translates along the axis 96. In such a case, the formation of the projections 82 by the punches 110 may require that the punches be translated along an axis other than 96, which most likely will occur during a separate operation from the permanent deformation of the bracket 30 by the die set 90.

The amount of permanent deformation of the bracket 30 in the second state and the resulting contact force between the surface 34 of the header 12 and each of the bands 44, 46 and 48 will depend upon the requirements and configuration of each application. For example, in many conventional heat exchangers, the ends 20 of the heat exchange tubes 14 are brazed into the tube slots 18 of the header 12. In such constructions, it may be convenient to form a brazed connection between the surface 34 of the header 12 and one or more of the bands 44, 46, and 48. In such an application, the amount of permanent deformation of the bracket 30 in the second state may be only so much as is required to provide a snug fit between the surface 34 of the header and the bands 44, 46 and 48 to hold the bracket in place during the brazing and to allow for a suitable brazing bond to form. This snug fit may produce only a nominal contact force between the surface 34 and the bands 44, 46, and 48. Indeed, in some applications, the openings 50 and 51, may have a sufficiently close fit in the first state of the bracket 30 to allow the bracket 30 to be maintained in its desired position for brazing by only the engagement of the projections 82 in the apertures 80, without ever having to deform the bracket 30 into the second state. In many heat exchangers utilizing brazing between the heat exchange tubes 14 and the header slots 18, it is common for the tubes 14 and/or the header 12 to be clad with brazing material. In such a case, there is a possibility that the brazing material will be drawn away from the connection between the ends 20 of the heat exchange tubes 14 and the tube slots 18 by wicking that would occur between the surface 34 and one or more of the bands 44, 46 and 48. To minimize this phenomena, it may be desired in some applications to clad brazing compound onto one or more of the surfaces of the bands 44, 46 and 48 that contact the surface 34 of the header. This can be accomplished by either selectively applying braze alloy to the surfaces, by forming the bracket from sheet material that has had brazing material cladded upon one or both of its faces, or by applying brazing material onto the bracket 30 after it is formed. Alternatively, as shown by the phantom lines in FIG. 4, protruding bumps or dimples 112 can be provided on one or more of the surfaces of the bands 44, 46 and 48 so that a sufficient portion of the surface area will be spaced from the surface 34 of the header 12 to prevent or minimize the wicking action there between. In this regard, the dimples 112 can be used in connection with cladding of the surfaces on which the dimples 112 are formed.

In some applications, it may be preferred that the bracket be held in place on the header 12 without any reliance upon a brazed connection therebetween. In such applications, the permanent deformation of the bracket 30 in the second state must provide sufficient clamping contact between the surface 34 of the header 12 and the bands 44, 46 and 48 to generate a sufficient contact force there between to maintain the bracket in its desired position on the header 12. Obviously, the amount of clamping required will vary with the application and depend upon the anticipated forces that will be exerted on the heat exchanger 10 and the bracket 30.

While it is preferred to contact the bend radii R of the end segments 56, 58, 64, and 66 to obtain the permanent deformation of the bracket 30 in the second state, in some applications it may be advantageous to permanently deform the bracket 30 by contacting other portions of the bracket 30. Indeed, any permanent deformation that results in the bands 44, 46, and 48 clamping the surface 34 in the openings 50 and 51 may be acceptable for some applications regardless of which portions of the bracket 30 are contacted during the transition from the first state to the second state. For example, in some applications it may be advantageous to contact end segments 56, 60, and 64 adjacent their respective bridge segments 68 and 72 to permanently deform the end segment 60 out of plane with the end segments 56 and 64.

While it is preferred that the bracket 30 include the apertures 80 for engagement with the projections 82, in some applications the apertures 80 and the projections 82 may not be required. For example, in some applications, the clamping force or a brazed connection between the bracket 30 and the header 12 may be sufficient to fix the bracket 30 against rotation relative to the header 12 for the anticipated forces. By way of further example, another feature of the bracket 30, such as the mount tab 42, may contact another portion of the heat exchanger 10 to prevent rotation of the bracket 30 relative to the header 12.

Similarly, while it is preferred that there be three bands, 44, 46 and 48, in some applications, it may be advantageous to eliminate one of the bands, such as the band 48 while retaining the bands 44 and 46. On the other hand, in some applications, it may be desirable to add one or more of the bands 44, 46 and 48 in addition to the three shown in the illustrated embodiment. For example, an additional band 46 could be provided on the opposite side of the band 48.

While aluminum has been listed as one possible material for the bracket 30, any material having a suitable strength, modulus of elasticity, ductility, and resilience for the requirements of the particular application may be used.

Moreover, while the illustrated embodiment shows a specific form for the tab 42, it should be understood that the specific form of the tab 42 for the bracket 30 will vary depending upon the particular application and that the tab 42 may take on any shape required to form a suitable attachment with a structure other then the header 12, such as for example another manifold 12, a conduit for use in connection with a heat exchange 10, a frame for supporting the heat exchanger 10, or another bracket that is then attached to another structure.

Further, while in the illustrated embodiment the transverse cross section of the surface 34 and the openings 50 and 51 are nominally circular, other cross sectional shapes for the surface 34 and the headers 12 can be accommodated by the bracket 30, as noted earlier. Additionally, while the illustrated embodiments show the width W1 and W2 of the slots 52 and 53 as being comparable to the widths of the bands 44 and 48, in some applications it may be desirable for the widths W1 and W2 of the slots 52 and 53 to be relatively larger than any of the bands 44, 46 and 48. Conversely, it may be desirable in other applications to form the slots 52 and 53 by simply slitting the material of the bracket 30 without removing any material therefrom to form the slots 52 and 53. This would result in very narrow widths W1 and W2 and in very narrow bridge segments 68, 70, 72 and 74. However, it should be noted that very narrow slots 52 and 53, such as would be formed by slitting, may result in shearing of the bracket at the bridge segments 68, 70, 72 and 74, and that the slitting operation may undesirably deform the individual cross sections of each of the bands 44, 46 and 48 such that the bands do not present a nominally flat surface for engagement with the surface 34 of the header 12 and the openings 50 and 51 are not of the desired size in the first state. Further, while the illustrated embodiment shows the widths W1 and W2 of the slots 52 and 53 as being nominally equal and symmetric along their length, it may be desirable in some applications to make the width of the slot 52 different then the width of the slot 53 and/or to make either one or both of the slots 52 and 53 with widths that vary over their length. Similarly, while the bands 44 and 48 are shown as having nominally equal widths that are constant over their length, it may be desirable in some applications for the width of the bands 44 and 48 to be unequal to each other and/or for the width of the bands 44 and 48 to vary over their length. Additionally, while the bend radii R are shown as being nominally equal, it may be desirable in some applications for one or more of the bend radii R to be different from the others. It may also be desirable in some applications for the width of the band 46 to vary over its length.

Additionally, while the illustrated embodiment shows the apertures 80 as cylindrical, through bores, in some applications it may desirable for the apertures 80 to extend less then completely through the band 46 and/or to have cross sectional shapes other then circular, such as for example, rectangular or triangular. Additionally, while the illustrated embodiment shows two of the apertures 80 and projections 82, it may be desirable in some applications to utilize a single aperture 80 and projection 82 or more than two apertures 80 and projections 82. Further, while the illustrated embodiment shows the apertures 82 as being fully confined within the band 46 it may be desirable in some applications to form the apertures 82 on the edge of the band 46, as shown by the hidden lines 84 in FIG. 5. Finally, while the illustrated embodiment shows the apertures 80 being formed in the band 46, it may be desirable in other applications to form the apertures 80 in either, or both, of the bands 44 and 48 as an addition or an alternative to the formation of the apertures 80 in the band 46.

Thus, it should be understood that the specific details of each of the elements 42, 44, 46, 48, 50, 51, 52, 53, 54, 55, 56, 58, 60, 62, 64, 66, 68, 70, 72, 74 and 80 of the bracket 30 and the associated die set 90 will vary depending upon the specific details of the heat exchanger 10 and the manifold 12 to which it is attached. For example, the cross sectional shape or shapes of the manifold 12, the materials of the manifold 12 and the bracket 30, the forces to which the bracket 30 will be subjected, and the type, spacing, number, and shape of the heat exchanger conduits are tubes 14 can all effect the specific details of the bracket 30.

Figure 8:
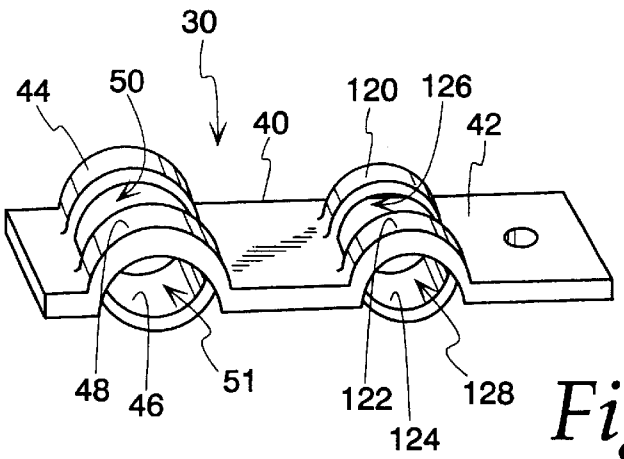
FIG. 8 is a perspective view of another embodiment of the mount bracket.

One alternative embodiment of the bracket 30 is shown in FIG. 8. In this embodiment, the mount tab 42 includes a set of bands 120, 122 and 124 that define coaxial openings 126 and 128 shaped to nominally conform to a mount tab receiving surface on a structure (not shown) other than the header 12, such as an outlet jumper tube or another manifold. The details of the bands 120, 126 and 124 and their assembly to the mount tab receiving surface on the other structure are essentially identical to the details and assembly previously described for the bands 44, 46 and 48. Thus, the previous description in connection with the bands 44, 46 and 48 and their assembly onto the header 12 applies equally well to the bands 120, 122 and 124 and their assembly to the mount tab receiving surface on the other structure. Further, the options described above for the details and assembly of the bands 44, 46 and 48 also applies equally well to the bands 120, 122 and 124. Accordingly, for the sake of brevity, a repetitive discussion of this information for the bands 120, 122, and 124 will be avoided.

What is claimed is:

1. A mount bracket for an elongate manifold of a heat exchanger, the manifold having a longitudinal axis and a mount bracket receiving exterior surface extending over at least a portion of the longitudinal length of the manifold, the mount bracket comprising:

a manifold receiving body formed from a single piece of material, said body including a mount tab configured to connect said mount bracket to a structure other than said manifold, and first and second opposed bands defining a manifold receiving opening shaped to nominally conform to said mount bracket receiving exterior surface, the first band spaced longitudinally from the second band with the bracket mounted on the manifold, the first band defining a first portion of the opening, the second band defining a second portion of the opening opposite the first portion, each of the first and second bands having a first end segment spaced from a second end segment, a first bridge segment connecting the first end segments of the first and second bands, and a second bridge segment connecting the second end segments of the first and second bands, the body being permanently deformable from a first state wherein said bands will slidably receive said mount bracket receiving exterior surface in said manifold receiving opening with a slip fit, and a second state wherein said bands will clamp said mount bracket receiving exterior surface in said manifold receiving opening.

2. The mount bracket of claim 1 wherein said mount bracket receiving exterior surface has a transverse cross-section with a nominally circular shape, and said manifold receiving opening has a nominally circular shape in said first state.

3. The mount bracket of claim 1 wherein said body further comprises at least one projection receiving aperture in at least one of said first and second bands, said at least one aperture shaped to receive a projection formed on said mount bracket receiving exterior surface.

4. The mount bracket of claim 1 wherein said body further comprises a third band that is longitudinally spaced from the second band on a side thereof opposite from the first band with the bracket mounted on the manifold, said third band being shaped like said first band and having corresponding first and second end segments respectively connected to the first and second end segments of said second band by additional first and second bridge segments.

5. The mount bracket of claim 1 wherein said mount tab comprises third and fourth opposed bands defining a second opening shaped to nominally conform to a mount tab receiving surface on a structure other than said manifold, the third band spaced longitudinally from the fourth band with the bracket mounted on the manifold, the third band defining a first portion of the second opening, the fourth band defining a second portion of the second opening opposite the first portion defined by the third band, each of the third and fourth bands having a first end segment spaced from a second end segment, a third bridge segment connecting the first end segments of the third and fourth bands, and a fourth bridge segment connecting the second end segments of the third and fourth bands, the body being permanently deformable from a third state wherein said third and fourth bands will receive said mount tab slidably receiving surface in said second opening with a slip fit, and a fourth state wherein said third and fourth bands will clamp said mount tab receiving surface in said second opening.

6. The mount bracket of claim 5 wherein said mount tab further comprises a fifth band that is longitudinally spaced from the fourth band on a side thereof opposite from the third band with the bracket mounted on the manifold, said fourth band being shaped like said third band and having corresponding first and second end segments respectively connected to the first and second end segments of said fourth band by additional first and second bridge segments.

7. A mount bracket for a elongate manifold of a heat exchanger, the manifold having a longitudinal axis and a mount bracket receiving exterior surface extending over a portion of the longitudinal length of the manifold, the mount bracket comprising:

a manifold receiving body formed from a single piece of material, said body including a mount tab configured to connect said mount bracket to a structure other than said manifold.

first, second, and third bands defining longitudinally spaced, coaxial manifold receiving openings shaped to nominally conform to said mount bracket receiving exterior surface, said first and third bands spaced longitudinally from the second band on opposite sides of the second band with the bracket mounted on the manifold, the first and second bands defining a first one of said openings, the second and third bands defining a second one of said openings spaced longitudinally for the first one of said openings, each of the first, second, and third bands having a first end segment spaced from a second end segment, a first bridge segment connecting the first end segments of the first and second bands, a second bridge segment connecting the second end segments of the first and second bands, a third bridge segment connecting the first end segments of the third and second bands, and a fourth bridge segment connecting the second end segments of the third and second bands, the body being permanently deformable from a first state wherein said bands will slidably receive said mount bracket receiving exterior surface in said manifold receiving openings with a slip fit, and a second state wherein said bands will clamp said mount bracket receiving exterior surface in said manifold receiving openings.

8. The mount bracket of claim 7 wherein said mount bracket receiving exterior surface has a transverse cross-section with a nominally circular shape, and said manifold receiving openings have nominally circular shapes in said first state.

9. The mount bracket of claim 7 wherein said body further comprises at least one projection receiving aperture in said second band, said at least one aperture shaped to receive a projection formed on said mount bracket receiving exterior surface.

10. The mount bracket of claim 7 wherein said mount tab comprises fourth and fifth opposed bands defining a third opening shaped to nominally conform to a mount tab receiving surface on a structure other than said manifold, the fourth band spaced longitudinally from the fifth band with the bracket mounted on the manifold, the fourth band defining a first portion of the third opening, the fifth band defining a second portion of the third opening opposite the first portion defined by the fourth band, each of the fourth and fifth bands having a first end segment spaced from a second end segment, a fifth bridge segment connecting the first end segments of the fourth and fifth bands, and a sixth bridge segment connecting the second end segments of the fourth and fifth bands, the body being permanently deformable from a third state wherein said fourth and fifth bands will slidably receive said mount tab receiving surface in said third opening with a slip fit, and a fourth state wherein said fourth and fifth bands will clamp said mount tab receiving surface in said third opening with an interference fit.

11. The mount bracket of claim 10 wherein said mount tab further comprises a sixth band that is longitudinally spaced from the fifth band on a side thereof opposite from the fourth band with the bracket mounted on the manifold, said sixth band being shaped like said fourth band and having corresponding first and second end segments respectively connected to the first and second end segments of said fifth band by additional seventh and eighth bridge segments.

12. A manifold/mount bracket assembly for a heat exchanger, the assembly comprising:

an elongate manifold for a heat exchanger, the manifold having a longitudinal axis and a mount bracket receiving exterior surface extending over at least a portion of the longitudinal length of the manifold, and at lease one heat exchanger tube in fluid communication with the interior of the manifold; and a mount bracket comprising a manifold receiving body formed from a single piece of material, said body including a mount tab configured to connect said mount bracket to a structure other than said manifold, first and second opposed bands defining a manifold receiving opening shaped to initially slidably receive and be clamped to said mount bracket receiving exterior surface, the first band spaced longitudinally from the second band with the bracket mounted on the manifold, the first band engaging a first portion said mount bracket receiving exterior surface, the second band engaging a second portion of said mount bracket receiving surface opposite the first portion, each of the first and second bands having a first end segment spaced from a second end segment, a first bridge segment connecting the first end segments of the first and second bands, and a second bridge segment connecting the second end segments of the first and second bands.

13. The assembly of claim 12 wherein at least one of said bands is bonded to said mount bracket receiving exterior surface.

14. The assembly of claim 12 wherein said mount bracket receiving exterior surface has a transverse cross-section with a nominally circular shape and said manifold receiving opening has a nominally circular shape.

15. The mount bracket of claim 12 wherein said body further comprises at least one projection receiving aperture in at least one of said first and second bands, said at least one aperture shaped to receive a projection formed on said mount bracket receiving exterior surface.

16. The mount bracket of claim 15 wherein said manifold includes a tube slot shaped to receive a heat exchanger tube, and said tube slot and said projection are located on nominally opposite sides of said manifold at nominally the same longitudinal position on said manifold.

17. The assembly of claim 12 wherein said body further comprises a third band that is longitudinally spaced from the second band on a side thereof opposite from the first band with the bracket mounted on the manifold, said third band being shaped like said first band and having corresponding first and second end segments respectively connected to the first and second end segments of said second band by additional first and second bridge segments.

18. A manifold/mount bracket assembly for a heat exchanger, the assembly comprising:

an elongate manifold for a heat exchanger, the manifold having a longitudinal axis, a mount bracket receiving exterior surface extending over at least a portion of the longitudinal length of the manifold, and an outwardly extending projection formed on said mount bracket receiving exterior surface, and at least one heat exchanger tube in fluid communication with the interior of the manifold; and a mount bracket comprising a manifold receiving body formed from a single piece of material, said body including a mount tab configured to connect said mount bracket to a structure other than said manifold, first and second opposed bands defining a manifold receiving opening shaped to receive said mount bracket receiving exterior surface, the first band spaced longitudinally from the second band with the bracket mounted on the manifold, the first band defining a first portion said manifold receiving opening, the second band defining a second portion of said manifold receiving opening opposite the first portion, each of the first and second bands having a first end segment spaced from a second end segment, a first bridge segment connecting the first end segments of the first and second bands, a second bridge segment connecting the second end segments of the first and second bands, and at least one aperture in at least one of said first and second bands, said at least one aperture receiving said projection formed on said mount bracket receiving exterior surface.

19. The assembly of claim 18 wherein said bands engage said mount bracket receiving exterior surface clamping said mount bracket receiving surface in said manifold receiving opening.

20. The assembly of claim 18 wherein at least one of said bands is bonded to said mount bracket receiving exterior surface.

21. The assembly of claim 18 wherein said mount bracket receiving exterior surface has a transverse cross-section with a nominally circular shape, and said manifold receiving opening has a nominally circular shape.

22. The mount bracket of claim 18 wherein said manifold includes a tube slot shaped to receive a heat exchanger tube, and said tube slot and said projection are located on nominally opposite sides of said manifold at nominally the same longitudinal position on said manifold.

23. The assembly of claim 18 wherein said body further comprises a third band that is longitudinally spaced from the second band on a side thereof opposite from the first band with the bracket mounted on the manifold, said third band being shaped like said first band and having corresponding first and second end segments respectively connected to the first and second end segments of said second band by additional first and second bridge segments.

24. A method of assembling a mount bracket to an elongate manifold of a heat exchanger, the method comprising the steps of:

a) inserting a manifold into an opening defined by first and second opposed bands of a mount bracket;

b) permanently deforming the mount bracket to reduce a dimension of the opening to bring the first and second bands into clamping contact with the manifold; and c) permanently deforming the manifold to create a projection that is engaged in an aperture in one of the first and second opposed bands.

25. The method of claim 24 wherein step c) comprises inserting a punch through a tube slot in said manifold.

26. The method of claim 24 wherein steps b) and c) are performed at nominally the same time.

27. The method of claim 26 wherein steps b) and c) are performed by a die tool that permanently deforms the manifold and the bracket.

28. The method of claim 27 wherein said die tool carries a punch, step b) comprises engaging at least one of the first and second opposed bands with the die tool, and step c) comprises inserting the punch through a tube slot in said manifold.

29. A method of assembling a mount bracket to an elongate manifold of a heat exchanger, the method comprising the steps of:

a) inserting a manifold into an opening defined by first and second opposed bands of a mount bracket;

b) permanently deforming the mount bracket to reduce a dimension of the opening to bring the bands into contact with the manifold; and c) bonding at least one of the bands to the manifold after step b).

30. The method of claim 29 further comprising the step of permanently deforming the manifold to create a projection that is engaged in an aperture in one of the first and second opposed bands prior to performing step c).

* * * * *